United States Patent [19]

Zandel

[11] Patent Number: 4,719,790

[45] Date of Patent: Jan. 19, 1988

[54] TABLE SHIFT APPARATUS FOR LARGE HYDRAULIC PRESSES

[75] Inventor: Adam Zandel, Forest Hills, N.Y.

[73] Assignee: Press Technology Corporation, White Plains, N.Y.

[21] Appl. No.: 33,905

[22] Filed: Mar. 31, 1987

Related U.S. Application Data

[63] Continuation of Ser. No. 820,111, Jan. 21, 1986, abandoned.

[51] Int. Cl.[4] ..... B30B 15/06; B21J 13/08

[52] U.S. Cl. ..... 72/448; 100/918; 100/229 R; 100/224; 83/563

[58] Field of Search ..... 72/448, 446; 83/563, 83/400, 266; 100/918, 229 R, 224, 53

[56] References Cited

U.S. PATENT DOCUMENTS

| | | | |
|---|---|---|---|
| 2,940,384 | 6/1960 | Munschaver et al. | 100/918 |
| 3,273,490 | 9/1966 | Beard | 72/446 |
| 3,831,427 | 8/1974 | Lee | 72/448 |
| 3,878,773 | 4/1975 | Smit | 100/918 |
| 3,935,811 | 2/1976 | Lenz et al. | 72/448 |
| 3,942,431 | 3/1976 | Goff | 100/918 |

FOREIGN PATENT DOCUMENTS

| | | | |
|---|---|---|---|
| 19660 | 6/1971 | Japan | 100/918 |
| 939551 | 10/1963 | United Kingdom | 100/918 |

*Primary Examiner*—Robert L. Spruill
*Assistant Examiner*—David B. Jones
*Attorney, Agent, or Firm*—Ostrolenk, Faber, Gerb & Soffen

[57] ABSTRACT

A table shift apparatus for large hydraulic presses employs two sets of cylinders for moving the working table of the press back and forth along a given path. To prevent ram buckling as would occur if rams or pistons were operated in compression, a first group of cylinders operated in tension only is provided for pulling the table in one direction while a second group of cylinders disposed at the other end of the path and also operated in tension is used for pulling the table back. While one group of cylinders is pulling the table the other group may assist the pulling operation by pushing the table as long as the applied hydraulic pressure is controlled to prevent buckling of its rams under all circumstances.

10 Claims, 2 Drawing Figures

TABLE SHIFT APPARATUS FOR LARGE HYDRAULIC PRESSES

This is a continuation application of Ser. No. 820,111, filed on Jan. 21, 1986, in the name of Adam Zandel, for Table Shift Apparatus for Large Hydraulic Presses, now abandoned.

BACKGROUND OF THE INVENTION

The present invention relates to forging presses and more particularly relates to a table shift apparatus for large hydraulic presses.

The present application is related to the general subject matter described in patent application Ser. No. 821,790 A Forging Press with Adjustable Daylight and with Yoke Design for Attaching Tierods to Crossheads which is commonly assigned with the present application. The subject matter thereof is incorporated herein by reference.

Forging presses as is well known are used for shaping metal slabs or ingots into end products of desired shape by pressing the metal slab between a pair of dies to give it its shape. To this end the forging press comes equipped with a working table of considerable dimensions which table is loaded with dies and bolsters and the unshaped metal slab. A table of this type can measure 30 feet in length and weigh close to 1,000 tons.

At times it is necessary to shift the table in and out from under the press at a considerable speed for heavy components of this type. Speeds of 700–800 inches per minute over distances of 100 feet are contemplated.

In prior art devices movement of the working table is effected by an actuator, usually of the water or oil hydraulic type which is capable of developing an operating force of 300 tons or more and which consists of one or more hydraulic cylinders and rams which pull the working table from under the press and then push it back into place.

Pulling the heavy working table is not difficult because the rams of the hydraulic cylinders work in tension only. Consequently, the table can be moved out from under the press at considerable speed. On the other hand, during pushing operations the long cylinder rams are in compression and thus susceptible to buckling. As a result it has been customary to complete the pushing operation in two stages and at a slower pace. This prior art arrangement adversely affects both the overall efficiency of the forging press and the size and capacity ratings of the hydraulic cylinders required for moving the working table.

SUMMARY OF THE INVENTION

It is therefore an object of the present invention to provide a more efficient apparatus for moving the working table of a forging press.

It is another object of the present invention to provide a table shift apparatus capable of moving the working table back and forth at considerable speed.

It is still another object of the present invention to provide a table shift apparatus which is not susceptible to cylinder ram buckling.

The foregoing and other objects of the present invention are realized with a table shifting apparatus which includes a first group of one or more hydraulically operated cylinders connected at one end thereof to a stationary member of the forging press and at the other end to the working table. The first group of cylinders are operated to pull the table from under the forging press in the conventional manner. A second group of one or more hydraulically operated cylinders is disposed within a stationary platen on which the working table is located. One end of the second group of cylinders is connected to a stationary member of the forging press which is located on an opposite side of the table as viewed with respect to the first group of cylinders and also to the working table itself. To return the table back into place under the forging press the second group of cylinders are operated to pull—rather than push—the table back into place.

As a result, and by providing a second group of cylinders which operate in tension only, the working table can be both removed from under the press and returned to its original location at considerable speeds. Although a second group of cylinders are required, the inclusion thereof is economically justified in view of the reduced size and capacity rating of all the cylinders. In connection with the above it should be noted that it is conceivable, although not contemplated presently, to control the two cylinder groups so that when one cylinder group pulls the working table the other cylinder group assists the operation by pushing the table under controlled conditions.

Other features and advantages of the present invention will become apparent from the following description of a preferred embodiment thereof which is described below in conjunction with the appended drawings.

DETAILED DESCRIPTION OF THE INVENTION

Figure 1:
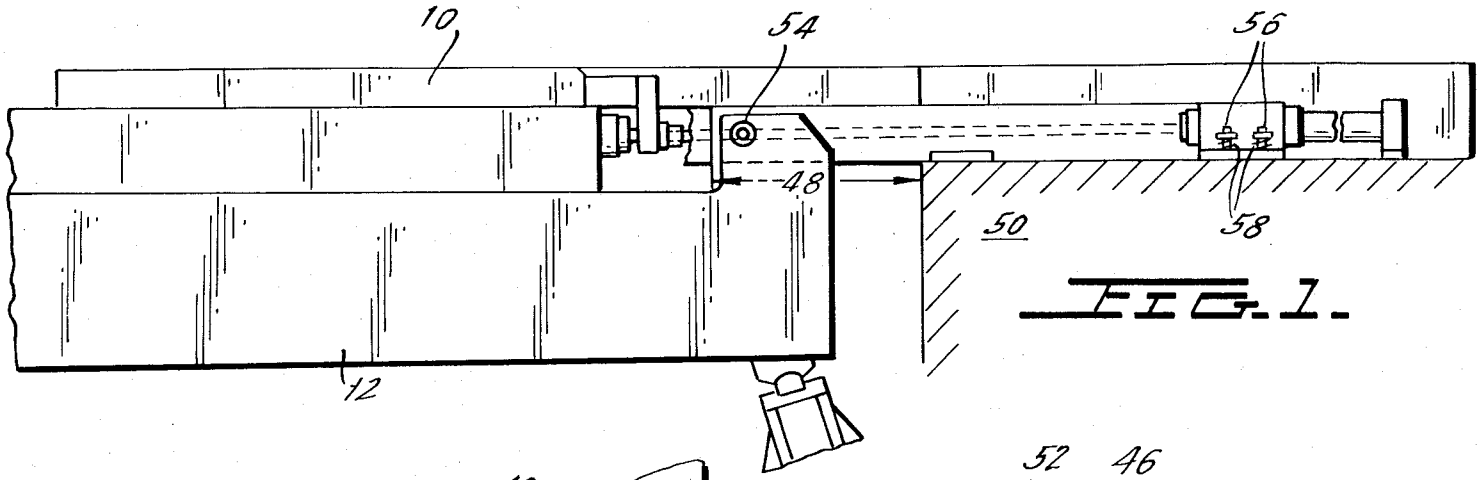
FIG. 1 is an elevational cross section to the table and table shifting apparatus in accordance with the present invention.
Figure 2:
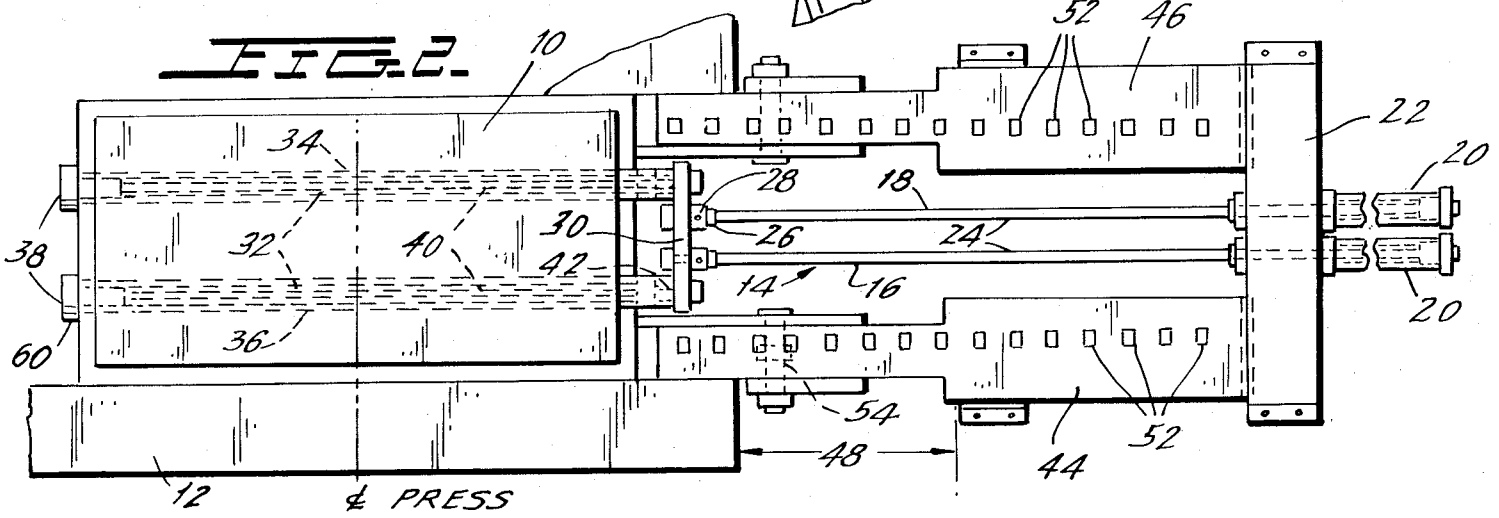
FIG. 2 is a top view of the table shifting apparatus embodiment shown in FIG. 1.

Referring to the drawings, a working table 10, in excess of 30 feet in length, rests on a stationary platen 12, which is firmly secured within the super structure of the forging press. First cylinder group 14 includes first cylinder 16 and second cylinder 18 each of which have a cylinder member 20 anchored in a stationary frame component 22, and a cylinder ram 24. Cylinder rams or pistons 24 travel in and out of their cylinders upon actuation by a source of pressurized hydraulic fluid (not shown). A distal threaded end 26, of each ram is connected by means of nuts 28 to a pulling member 30, which is firmly secured to the table 10.

Second cylinder group 32 includes a respective pair of first and second cylinders 34 and 36 which are disposed within table 10. As above, each cylinder has an immovable main cylinder member 38, and a movable piston or ram 40. Cylinder member 38 are secured to platen 12 by any appropriate means. Ends 60 of cylinder 32 protrude out of platen 12 to enable servicing of cylinder seals (not shown) incorporated therein. The free end 42 of each ram 40 is secured to pulling member 30 of table 10.

First and second track plates 44 and 46 extend from platen 12 located in the press to foundation floor 50 thereby bridging a gap 48 which otherwise separates platen 12 and foundation floor 50. Table 10 will slide over tracks 44 and 46, which for this purpose include slide bearings 52. Instead of or supplementing bearings 52, tracks 44 and 46 may be lubricated by appropriate liquid or powdered lubricants.

At the platen end, tracks 44 and 46 are connected by bolts or link pins 54 which provide a measure of pivoting flexibility in the connection. The other ends of the tracks are secured resiliently to foundation floor 50 by means of bolts 56 and springs 58. Thus, expansions and contractions, due to heat generated during operation, is absorbed by the flexible mounting of tracks 44 and 46.

In operation, when table 10 is to be moved from under the bridge, first cylinder group 24 will operate in tension to pull table 10 onto tracks 44 and 46. Optionally, but not necessarily, second cylinder group 32 may simultaneously push the table and thereby assist the task of the first cylinder group. Of course measures will be taken to assure that the second cylinder group is not overstressed to prevent buckling of its ram 40. Similarly, to pull the table 10 back into place, second cylinder group 32 whose rams 40 are now fully extended will operate in tension to pull table 10 back into the forging press. It should be understood that providing two cylinders in each cylinder group is preferred from mechanical balance and other considerations. However, any member or even a single cylinder will do at each side of table 10.

Although the present invention was described in connection with a preferred embodiment thereof, many other variations, modifications and uses will not become apparent to those skilled in the art. It is therefore preferred that the present invention be limited not by the specific embodiment disclosed herein but only by the dependent claims.

What is claimed is:

1. A shifting apparatus for slidingly moving a very heavy forging press component of a forging press back and forth along a given travel path which extends between first and second ends of said path, said apparatus comprising:

said heavy forging press component;

first cylinder/ram means connected at one end thereof to a stationary member of said forging press and at the other end thereof to said heavy press component, said first cylinder/ram means having a ram means and means for operating said ram means solely in tension to pull said heavy press component from said first end to said second end along said path; and second cylinder/ram means connected at one end thereof to another stationary member of said forging press and at the other end thereof to said heavy press component, said second cylinder/ram means having a respective ram means and a respective operating means arranged with respect to said heavy press component and said first cylinder/ram means for operating said ram means of said second cylinder/ram means solely in tension to pull said heavy press component from said second end to said first end along said path, each said ram means of said first and second cylinder/ram means being constructed such that said ram means is sufficiently sturdy to enable said ram means to operate in tension to pull said press component and is inadequate to permit said ram means to be operated in compression to push said press component whereby said ram means operate mutually exclusively of one another and each of said ram means has a reduced size and capacity configuration.

2. The apparatus of claim 1 in which said press component is a working table for said forging press which is loadable with dies and bolsters associated with forging operations.

3. The apparatus of claim 2 wherein said working table is of a type having a weight of about 1,000 tons.

4. The apparatus of claim 3 in which said first and second cylinder/ram means are operable to move said working table at a speed of about 700–800 inches per minute and over a distance which is greater than the dimension of said working table as measured along said given path.

5. The apparatus of claim 4 wherein said cylinder/-ram means are hydraulically operable from pressurized hydraulic fluid which is used to operate said forging press itself.

6. The apparatus of claim 5 in which each one of said first and second cylinder/ram means includes a plurality of hydraulic cylinders and a respective ram for each cylinder, the cylinders being arranged in parallel to one another and simultaneously operable.

7. The apparatus of claim 6 in which stationary components associated with said first cylinder group are secured to a frame which rests on a foundation of said forging press.

8. The apparatus of claim 7 wherein a portion of said second cylinder/ram means is stationary and is located within a platen on which said table rests during operation, said stationary cylinder portion including ends which protrude from said platen to permit servicing and maintenance of hydraulic seals located in said second cylinder/ram means.

9. The apparatus of claim 1, further including tracks disposed adjacent one of said cylinder/ram means for providing a sliding surface for said heavy press component.

10. The apparatus of claim 9 wherein said tracks are resiliently connected at one end to a platen on which said heavy press component is located and at another end to a foundation member of said forging press in a manner which absorbs expansion and contraction in components of said forging press during operation thereof.

* * * * *